US012137772B2

(12) United States Patent
Parisotto et al.

(10) Patent No.: US 12,137,772 B2
(45) Date of Patent: Nov. 12, 2024

(54) SKI BOOT

(71) Applicant: CALZATURIFICIO S.C.A.R.P.A. S.P.A., Asolo (IT)

(72) Inventors: Davide Parisotto, Asolo (IT); Elenio Menegon, Asolo (IT)

(73) Assignee: CALZATURIFICIO S.C.A.R.P.A. S.P.A. (IT)

( * ) Notice: Subject to any disclaimer, the term of this patent is extended or adjusted under 35 U.S.C. 154(b) by 85 days.

(21) Appl. No.: 17/698,486

(22) Filed: Mar. 18, 2022

(65) Prior Publication Data

US 2022/0330650 A1 Oct. 20, 2022

(30) Foreign Application Priority Data

Mar. 23, 2021 (IT) ..... 102021000006962
Feb. 22, 2022 (IT) ..... 102022000003257

(51) Int. Cl.
*A43B 5/04* (2006.01)

(52) U.S. Cl.
CPC ..... *A43B 5/0415* (2013.01); *A43B 5/0447* (2013.01); *A43B 5/046* (2013.01)

(58) Field of Classification Search
CPC .... A43B 5/0415; A43B 5/0435; A43B 5/0447
See application file for complete search history.

(56) References Cited

U.S. PATENT DOCUMENTS 4,937,952 A * 7/1990 Olivieri ..... A43C 11/16 36/118.9
6,267,390 B1 7/2001 Maravetz
6,416,074 B1 * 7/2002 Maravetz ..... A43C 11/165 36/119.1
8,858,482 B2 * 10/2014 Ingimundarson ..... A61F 5/0123 128/882

FOREIGN PATENT DOCUMENTS

EP 0504769 A1 9/1992
EP 3725175 A1 * 10/2020 ..... A43B 5/0447
WO WO8100507 A1 3/1981

* cited by examiner

*Primary Examiner* — Khoa D Huynh
*Assistant Examiner* — Erick I Lopez
(74) *Attorney, Agent, or Firm* — The Belles Group, P.C.

(57) ABSTRACT

A ski boot including a rigid foot-case that accommodates a user's foot, a rigid cuff, which is pivotally joined to the foot-case so as to be able to rotate about a reference axis substantially perpendicular to the midplane of the ski boot, and foot-case closing means which are adapted to selectively close/tighten the foot-case against the user's foot. The foot-case closing means includes an oblong, transversal locking band that extends transversally to the midplane of the ski boot and has a first end firmly fixed to a first lateral side of the foot-case, and a manually-operated coupling assembly, which is adapted to connect the second end of the transversal locking band selectively and alternatively to the foot-case or to the cuff, at a second lateral side of the foot-case opposite to said first lateral side.

20 Claims, 5 Drawing Sheets

SKI BOOT

CROSS-REFERENCE TO RELATED APPLICATIONS

This patent application claims priority from Italian patent applications no. 102021000006962 filed on Mar. 23, 2021, and no. 102022000003257 filed on Feb. 22, 2022, the entire disclosure of which is herein incorporated by reference.

TECHNICAL FIELD

The present invention relates to a ski boot.

More specifically, the present invention relates to an mountaineering ski boot, to which the following disclosure will explicitly refer without thereby losing generality.

STATE OF THE PRIOR ART

As is known, mountaineering ski boots currently on the market comprise: a rigid foot-case, which is mainly made of plastic or composite material, is substantially shoe-shaped so as to accommodate/hold the user's foot, and has the lower part specifically structured for being fixed to the back of a downhill ski or the like by means of a suitable mountaineering ski binding device; a rigid cuff, which is mainly made of plastic or composite material, is shaped so as to embrace from behind the lower part of the user's leg, and is hinged to the foot-case so as to be able to rotate about a transversal reference axis, which is substantially perpendicular to the vertical midplane of the ski boot, and also locally substantially coincides with the articulation axis of the ankle; and an internal inner-boot with a soft and thermal-insulating structure, which is inserted in removable manner into the foot-case and the cuff, and is shaped so as to accommodate and protect both the user's foot and the user's leg, approximately up to the height of the calf.

In most of the mountaineering ski boots currently on the market, the upper part of the foot-case is moreover provided with a longitudinal slit which extends in sagittal direction, over the instep and astride of the midplane of the ski boot, and the mountaineering ski boot additionally comprises an oblong and flattened in shape, protective tongue with a semi-rigid structure, which is generally separate and distinct from the foot-case, and is placed resting on the upper part of the foot-case, covering the longitudinal slit.

More specifically, the protective tongue is usually tip-hinged to the upper-front part of the foot-case so as to be able to flip forward and, when it is in abutment onto the upper part of the foot-case, it prevents snow and ice from penetrating inside the ski boot through the longitudinal slit.

The abovementioned mountaineering ski boots are finally provided with a foot-case closing mechanism, and with a cuff closing mechanism, both operated manually.

The foot-case closing mechanism is structured so as to be able to selectively close/tighten the upper part of the foot-case against the user's foot, so as to immobilise the user's foot inside the inner-boot. Whereas, the cuff closing mechanism is structured so as to be able to selectively close/tighten the upper part of the cuff against the user's leg, so as to immobilise the user's leg inside the inner-boot.

In most of the mountaineering ski boots currently on the market, the foot-case closing mechanism consists of one or two lever closing buckles that are arranged on the upper part of the foot-case, across and astride of the tongue, are fixed in rigid manner to the foot-case on opposite sides of the tongue, and are finally capable of pulling one toward the other the two edges of the foot-case flanking the longitudinal slit, so as to tighten the upper part of the foot-case against the user's foot.

Patent application EP3725175 A1, on the other hand, shows a mountaineering ski boot wherein the foot-case closing mechanism comprises: a strip of plastic material with a flexible and inextensible structure, which has the proximal end firmly fixed to the inner side of the foot-case, at the hinge connecting the cuff to the foot-case, and extends obliquely along the inner side up to reach and superimpose the protective tongue, so as to place the distal end of the flexible strip over the tongue, approximately astride of the midplane of the ski boot; a series of fairlead members which are arranged in an alternated manner on opposite sides of the outer longitudinal edge of the protective tongue, and are firmly fixed to the foot-case or to the protective tongue immediately beneath; and a small manually-operated cable-winding winch, which is firmly fixed to the distal end of the strip of plastic material, and is provided with a metal cable that exits the winch, engages in pass-through and free slidable manner the various fairlead members, passing from one side to the other of the outer longitudinal edge of the tongue, and finally has the distal end firmly anchored to the tongue or to the foot-case.

Object of the Invention

Aim of the present invention is to improve the foot-case closing mechanism described in patent application No. EP3725175 A1.

In accordance with these aims, according to the present invention there is provided a ski boot comprising: a substantially rigid foot-case, which is adapted to accommodate the user's foot and has the lower part structured to couple with a ski binding device; a substantially rigid cuff, which is adapted to surround the lower part of the user's leg, and is pivotally joined to the foot-case so as to be able to rotate about a transversal axis substantially perpendicular to the midplane of the ski boot; a protective tongue and/or gaiter, that closes the upper part of the foot-case; and foot-case closing means adapted to selectively close/tighten the foot-case on the user's foot;

the ski boot being characterised in that the foot-case closing means comprise: an oblong, transversal locking band with a flexible and substantially inextensible structure, which extends transversally to the midplane of the ski boot, astride of and flush to the protective tongue and/or gaiter, and has a first end firmly fixed/connected to a first lateral side of the foot-case; and a manually-operated coupling assembly, which is adapted to connect the second end of said transversal locking band selectively and alternatively to the foot-case or to the cuff, at a second lateral side of the foot-case opposite to said first lateral side.

Preferably, though not necessarily, the ski boot is moreover characterised in that the coupling assembly is adapted to tighten and keep tightened said transversal locking band.

Preferably, though not necessarily, the ski boot is moreover characterised in that the coupling assembly comprises: a first anchoring structure stably located on the foot-case, along the second lateral side of the foot-case; a second anchoring structure stably located on the cuff, at the second lateral side of the foot-case; and a manually-operated coupling and tensioning device, which is stably located on the transversal locking band and is selectively connectable/couplable, on choice and alternatively, to the first or to the second anchoring structure in a rigid and stable, though easily releasable manner, so as to anchor the locking band on choice and alternatively to the foot-case or to the cuff, always along the first lateral side of the foot-case.

Preferably, though not necessarily, the ski boot is moreover characterised in that the coupling assembly comprises: a movable anchoring element which is fixed in a rigid and stable, though removable manner, on choice and alternatively on the foot-case or on the cuff, at said second lateral side of the foot-case; and a manually-operated coupling and tensioning device, which is firmly fixed to the transversal locking band and is adapted to couple said transversal locking band in a rigid and stable, though easily releasable manner, to said movable anchoring element while tightening the same transversal locking band.

Preferably, though not necessarily, the ski boot is moreover characterised in that said movable anchoring element is structured so as to be able to couple/interlock in a rigid and stable, though easily removable manner, on choice and alternatively into a first seat located on the second lateral side of the foot-case; and into a second seat located on the cuff, immediately over said second lateral side of the foot-case.

Preferably, though not necessarily, the ski boot is moreover characterised in that said movable anchoring element is replaced by two stationary anchoring elements that are stably located one on the foot-case and the other on the cuff, along said second lateral side of the foot-case; the coupling and tensioning device being adapted to couple said transversal locking band in a rigid and stable, though easily releasable manner, on choice and alternatively on any one of said stationary anchoring elements.

Preferably, though not necessarily, the ski boot is moreover characterised in that said coupling and tensioning device is a manually-operated cable-tightening device, that is firmly fixed on the transversal locking band and is provided with a flexible cable that forms an extension of the transversal locking band, and is adapted to engage/couple said movable anchoring element or said stationary anchoring elements.

Preferably, though not necessarily, the ski boot is moreover characterised in that the flexible cable has the distal end anchored in rigid manner on the body of the protective tongue or of the foot-case, and wherein said movable anchoring element or said stationary anchoring elements include a first fairlead member adapted to be engaged in free slidable manner by a segment of the flexible cable.

Preferably, though not necessarily, the ski boot is moreover characterised in that the coupling assembly additionally comprises a plurality of second fairlead members, which are arranged in an alternated manner on opposite sides of a longitudinal edge of the protective tongue adjacent to said second lateral side of the foot-case, and are rigidly fixed to the foot-case or to the protective tongue immediately beneath; the flexible cable of the cable-tightening device being adapted to engage in a pass-through and free slidable manner and in succession said first and second fairlead members, passing from one side to the other of said longitudinal edge of the tongue.

Preferably, though not necessarily, the ski boot is moreover characterised in that the cable-tightening device is a manually-operated winch.

Preferably, though not necessarily, the ski boot is moreover characterised in that the first end of said transversal locking band is firmly fixed to said first lateral side of the foot-case, at the hinge connecting the cuff to the foot-case.

Preferably, though not necessarily, the ski boot is moreover characterised in that the transversal locking band comprises a flexible ribbon-like element with a substantially inextensible structure, which has the proximal end firmly fixed to the first lateral side of the foot-case, and extends obliquely along the first lateral side of the foot-case, towards the upper part of the foot-case and the midplane of the ski boot, so as to reach said protective tongue and/or gaiter.

Preferably, though not necessarily, the ski boot is moreover characterised in that said flexible ribbon-like element has a monolithic structure and/or is made of plastic material.

Preferably, though not necessarily, the ski boot is moreover characterised in that said first and said second lateral side of the foot-case are respectively the inner side and the outer side of the foot-case.

Preferably, though not necessarily, the ski boot is moreover characterised in that the protective tongue has the front end firmly fixed to the upper-front part of the foot-case, with the capability of flipping forward.

Preferably, though not necessarily, the ski boot is moreover characterised in that the distal end of the flexible cable is anchored in rigid manner to the body of the protective tongue or of the foot-case, close to the front end of the protective tongue.

Preferably, though not necessarily, the ski boot is moreover characterised in that a second end of said transversal locking band rests on the protective tongue, and is locally firmly fixed to the same protective tongue in a transversally sliding manner.

Preferably, though not necessarily, the ski boot is moreover characterised in that the second end of said transversal locking band is arranged resting on the protective tongue, and is provided with an oblong slot which extends transversally to the same locking band, and is engaged in free slidable manner by a protruding pin that juts out cantilevered from said protective tongue; said oblong slot being substantially rectilinear and/or parallel to said direction.

BRIEF DESCRIPTION OF THE DRAWINGS

The present invention will now be described with reference to the accompanying drawings, which illustrate a non-limiting example embodiment thereof, wherein:

FIG. 6 is a perspective view of the front part of a second alternative embodiment of the ski boot illustrated in the preceding figures, with parts removed for clarity's sake; whereas

PREFERRED EMBODIMENT OF THE INVENTION

Figure 1:
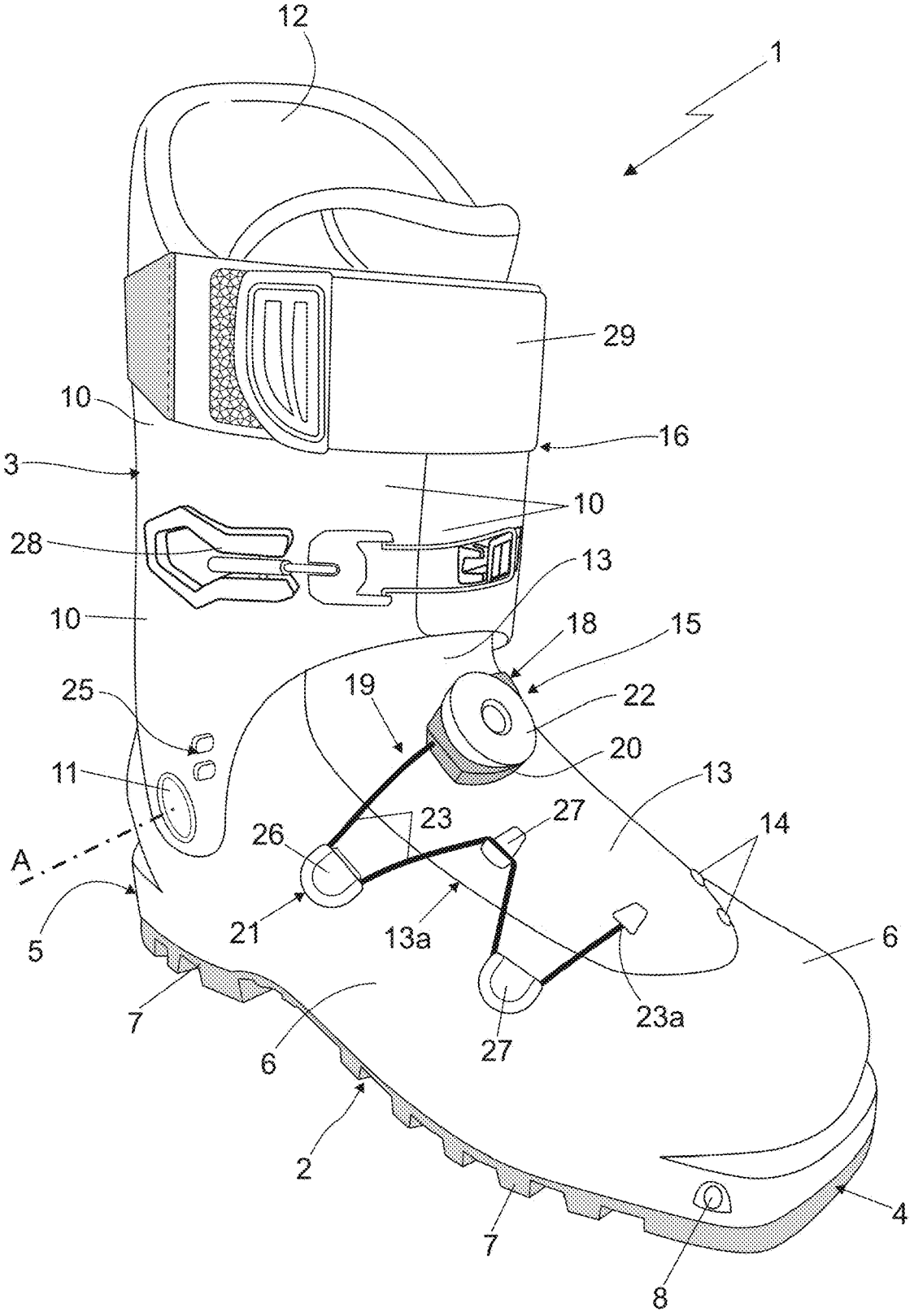
FIG. 1 is a perspective view of a ski boot realized according to the teachings of the present invention, with parts removed for clarity's sake.
Figure 2:
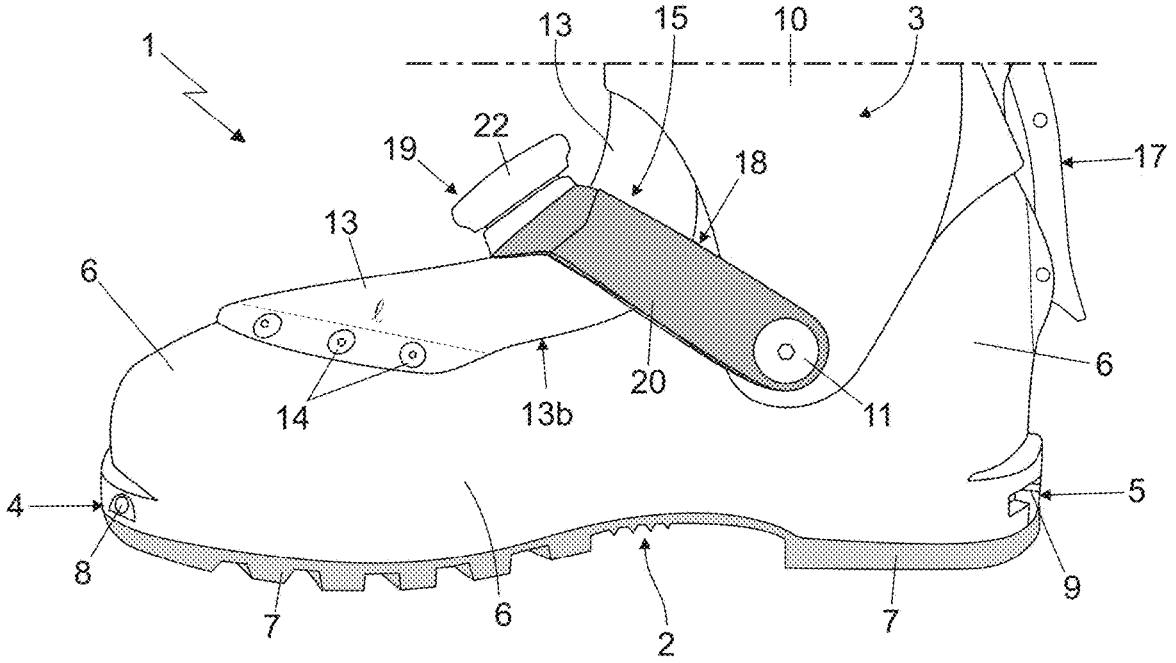
FIG. 2 is a side view of the ski boot illustrated in FIG. 1, with parts removed for clarity's sake.

With reference to FIGS. 1 and 2, reference number 1 denotes, as a whole, a ski boot that can be advantageously used for practicing the ski mountaineering or Telemark.

The ski boot 1 firstly comprises: a substantially rigid foot-case 2, which is substantially shoe-shaped and is adapted to accommodate/contain the user's foot; and a substantially rigid cuff 3, which is shaped so as to surround the lower part of the user's leg and is pivotally joined to the foot-case 2 so as to be able to freely swing about a transversal rotation axis A that is locally substantially perpendicular to the vertical midplane of the ski boot, and preferably also substantially coincides with the articulation axis of the user's ankle.

Preferably, the foot-case 2 moreover has the lower part specifically structured/shaped for being able to connect/couple in a rigid and stable, though easily releasable manner, to a ski binding device of known type (not shown), which in turn is adapted to be fixed in rigid manner to the back of a generic downhill ski or similar equipment.

More specifically, the lower part of foot-case 2 is preferably provided with a front tip 4 and with a rear heel 5.

The front tip 4 is preferably structured so as to connect/couple in a stable, though easily releasable manner, to the toe-piece (not shown) of a ski binding device which, in turn, is stably fixed to the back of a generic downhill ski or the like. Whereas, the rear heel 5 is preferably structured so as to connect/couple in a stable, though easily releasable manner, to the heel-piece (not shown) of a ski binding device which, in turn, is stably fixed to the back of a generic downhill ski or the like.

Still more specifically, the front tip 4 of foot-case 2 is preferably structured so as to connect/couple in known manner to the tip of a mountaineering ski binding device; whereas, the rear heel 5 of the foot-case 2 is preferably structured so as to be able to connect/couple in a known manner to the heel-piece of the same mountaineering ski binding device.

Preferably, the lower part of the foot-case 2 furthermore has a treaded profile so as to grip on snow and/or ice, and thus enable the user to walk on snow and ice in relative safety.

More specifically, with reference to FIGS. 1 and 2, the foot-case 2 preferably comprises: a substantially rigid shell 6 with a substantially oblong basin shape, which is preferably made of plastic and/or composite material, and is shaped so as to accommodate/contain the user's foot, preferably roughly up to the height of the ankle; and optionally a sole 7 preferably with treaded profile, which is preferably made of vulcanized rubber or other elastomeric material with high friction coefficient, and is firmly fixed to the bottom wall of shell 6 preferably by gluing.

In the example shown, in particular, the shell 6 is preferably made of PEBAX (polyester-amide), Nylon (polyamide) or other similar plastic polymer.

Clearly, shell 6 could also be made of a composite material preferably made up of one or more superimposed layers of carbon fibres and/or glass fibres and/or aramid fibres, suitably interweaved and/or superimposed on one another and embedded in a matrix of epoxy, phenolic or polyester resin preferably of thermosetting type.

In other words, the foot-case 2 is preferably mainly made of plastic and/or composite material.

With reference to FIGS. 1, 2, 3 and 4, in addition the foot-case 2 preferably also comprises: a rigid front insert 8, preferably made of metallic material, which is stably embedded/incorporated in the bottom wall of shell 6 in proximity of the tip 4 of foot-case 2, and is structured so as to connect/couple in known manner to the toe-piece (not shown) of the mountaineering ski binding device; and optionally also a rigid rear insert 9, preferably made of metallic material, which is instead embedded in shell 6 at the heel 5, and is structured so as to connect/couple in known manner to the heel-piece (not shown) of the same mountaineering ski binding device.

More specifically the rigid insert 8 has a plate-like structure and is dimensioned so as to surface/emerge outside of shell 6, on opposite sides of the front tip 4 of the foot-case, preferably in a substantially specular position with respect to the midplane of the ski boot, so that the two surfacing ends of the rigid insert 8 can connect in axially rotatable manner to the toe-piece of the mountaineering ski binding device.

With reference to FIGS. 1 and 2, the cuff 3 on the other hand preferably comprises a substantially rigid shell 10 preferably made of plastic and/or composite material, which is preferably substantially C-bent so as to cover the rear part of the user's leg, from the ankle substantially up to the height of the calf, and is moreover provided with two oblong and protruding lateral wings or flaps which extend forward on opposite sides of the midplane of the ski boot, so as to embrace from behind the user's leg roughly at the height of the calf, and then preferably superimpose one another at the front part of the leg, forming a tubular structure that surrounds the user's leg at the height of the calf.

Therefore, also the cuff 3 is preferably mainly made of plastic and/or composite material.

The cuff 3, in addition, is preferably fixed in free rotatable manner on the upper part of foot-case 2, or rather of shell 6, by means of two connecting hinges 11 preferably made of metallic material, which are located on the inner and outer lateral sides of the foot-case 2 and of the cuff 3, aligned along the transversal axis A, so as to allow the cuff 3 to freely swing forward and backward on the foot-case 2, while remaining always on a reference plane orthogonal to the transversal axis A and substantially coinciding with the midplane of the ski boot.

With reference to FIG. 1, in addition the ski boot 1 preferably also comprises an inner-boot 12 with a thermal-insulating structure, which is located inside the foot-case 2 and preferably also the cuff 3, and is shaped so as to accommodate and protect the user's foot and preferably also the lower part of the user's leg. Moreover the thermal-insulating inner-boot 12 is preferably provided with a soft and deformable internal lining, and is preferably inserted in manually-removable manner inside the foot-case 2 and preferably also the cuff 3.

The thermal-insulating inner-boot 12 minimises the heat losses towards the outside and prevents the user's foot and the user's leg from entering in direct contact with the foot-case 2 and/or the cuff 3.

More specifically, the thermal-insulating inner-boot 12 is preferably shaped substantially like a boot, and is dimensioned so as to accommodate and protect the user's foot and the lower part of the user's leg preferably roughly up to the top of the cuff 3. Preferably the inner-boot 12 furthermore has a structure of thermo-formable type.

With reference to FIGS. 1, 2, 3 and 4, in addition the ski boot 1 also comprises an oblong and flattened protective tongue 13, which is adapted to close the upper part of the foot-case 2, or rather the upper part of shell 6, so as to prevent snow and ice from penetrating inside the ski boot.

More specifically, the protective tongue 13 has a rigid or semi-rigid structure and is adapted to substantially entirely cover a large longitudinal slit (not visible in the figures), which preferably extends in a substantially sagittal direction along the upper part of the foot-case 2, or rather of the shell 6, while remaining over the user's instep and substantially astride of the midplane of the ski boot.

The protective tongue 13, in addition, is preferably separate and distinct from the foot-case 2, or rather from the shell 6, and is arranged resting on the upper part of the foot-case 2, or rather on the upper part of shell 6, substantially astride of the midplane of the ski boot.

Therefore, the protective tongue 13 extends in a substantially sagittal direction (i.e. parallel to the midplane of the ski boot), flush to the upper part of the foot-case 2, or rather to the upper part of shell 6, so that its two longitudinal edges, hereafter indicated by reference number 13*a* and 13*b*, are arranged resting on the foot-case 2, on opposite sides of the longitudinal slit of the foot-case 2 and of the midplane of the ski boot.

More specifically, the longitudinal edge 13*a* of protective tongue 13 is adjacent and adapted to rest on the outer side of the foot-case 2, whereas the longitudinal edge 13*b* is adjacent and adapted to rest on the inner side of the foot-case 2. Clearly, the longitudinal edges 13*a* and 13*b* are opposite one to the other.

Preferably, the protective tongue 13 is moreover made of plastic and/or composite material, and/or preferably has a monolithic structure.

Additionally, the protective tongue 13 is preferably stably fixed to the foot-case 2, or rather to the shell 6, with the capability of flipping forward, optionally also moving laterally toward the outer or inner side of the foot-case 2.

With reference to FIGS. 1, 2, 3 and 4, in the example shown, in particular, the oblong protective tongue 13 is preferably substantially L-bent, and is preferably structured so as to be able to substantially bend only at the elbow of the L.

Furthermore the protective tongue 13 is preferably arranged resting on the upper part of the foot-case 2, or rather on the upper part of shell 6, so that the front part of protective tongue 13 substantially entirely covers the longitudinal slit of the foot-case 2. Whereas, the rear part of protective tongue 13 extends cantilevered upward flush to the thermal-insulating inner-boot 12, preferably up to reach and optionally slip beneath the two oblong and protruding lateral wings or flaps of cuff 3, for covering and protecting the front part of the user's leg.

Additionally, the front end of tongue 13 is preferably firmly fixed to the upper-front part of the foot-case 2, or better of the shell 6, so that the protective tongue 13 can flip forward, preferably while remaining astride of a reference plane which is oblique (i.e. not perpendicular and not parallel) with respect to the midplane of the ski boot.

In the example shown, in particular, the tongue 13 is preferably fixed to the upper-front part of the foot-case 2, so as to be able of flipping forward moving laterally toward the inner side of the foot-case 2.

More specifically, with reference to FIGS. 1 and 2, in the example shown the front end of protective tongue 13 is preferably fixed in a rigid and stable manner to the foot-case 2, or rather to the shell 6, by means of a series of anchoring screws 14 located next to the front edge of the tongue 13. The tongue 13 furthermore has, behind the anchoring screws 14, a transversal bending line l which is structured so as to allow the rest of the protective tongue 13 to freely rotate forward. Preferably the bending line l moreover extends along the body of tongue 13 obliquely (i.e. not perpendicularly and not parallel) to the midplane of the ski boot, and the front edge of protective tongue 13 is preferably locally substantially parallel to the bending line l.

Clearly in a different embodiment, the front end of the protective tongue 13 may be firmly fixed to the upper-front part of the foot-case 2, or rather of the shell 6, via a normal hinge.

With reference to FIGS. 1 and 2, in addition the ski boot 1 is also provided with a foot-case closing mechanism 15 and with a cuff closing mechanism 16, preferably both manually operated.

The foot-case closing mechanism 15 is structured so as to selectively close/tighten the upper part of the foot-case 2 against the user's foot, in order to immobilise the user's foot inside the foot-case 2, or rather inside the inner-boot 12.

The cuff closing mechanism 16, in turn, is structured so as to selectively close/tighten the upper part of the cuff 3 against the user's leg, in order to immobilise the user's leg inside the cuff 3, or rather inside the inner-boot 12.

Preferably, the ski boot 1 is finally also provided with a manually-operated cuff locking device 17, which is structured so as to selectively lock the cuff 3 to the foot-case 2 in a predetermined downhill position, in which the cuff 3 is tilted forward with respect to the vertical of a given angle preferably ranging between 3° and 25°.

More specifically, the cuff locking device 17 is preferably fixed to the cuff 3 in the zone above the heel of the ski boot, substantially astride of the midplane of the ski boot, and is structured so as to, on choice and alternatively, connect the cuff 3 to the foot-case 2 so as to lock the cuff 3 in said downhill position; and completely unlock/release the cuff 3 from the foot-case 2 so as to allow the cuff 3 to freely swing forward and backward on the foot-case 2 about the transversal axis A, remaining on the midplane of the ski boot.

With reference to FIGS. 1, 2, 3 and 4, in turn, the foot-case closing mechanism 15 comprises: a transversal locking band 18, oblong in shaped and with a flexible and substantially inextensible structure, which extends transversally to the midplane of the ski boot, is arranged astride of the upper part of the foot-case 2, over and flush to the protective tongue 13, and has a first end firmly fixed to the inner side of foot-case 2, preferably at the connecting hinge 11; and a manually-operated coupling assembly 19, which is adapted to connect the second end of the locking band 18 selectively and alternatively to the foot-case 2 or to the cuff 3, at the outer side of the foot-case 2 and preferably in proximity of connecting hinge 11.

Preferably, the coupling assembly 19 is moreover capable of tightening and keeping tightened the transversal locking band 18.

Additionally, with reference to FIGS. 1 and 2, the transversal locking band 18 preferably consists of, or anyway comprises, a flexible ribbon-like element 20 with a substantially inextensible structure, which has the proximal end firmly fixed to the foot-case 2 and/or to the cuff 3, along the inner side of the foot-case 2 and in proximity of the connecting hinge 11, and extends obliquely along the inner side of the foot-case 2, toward the upper part of foot-case 2 and the midplane of the ski boot, so as to reach and rise over the protective tongue 13, preferably arriving at least up to the centreline of the protective tongue 13.

More specifically, the proximal end of the flexible ribbon-like element 20 is preferably firmly fixed to the connecting hinge 11, along the inner side of the foot-case 2.

Additionally, the flexible ribbon-like element 20 preferably has a monolithic structure and is preferably made of plastic material.

In other words, the flexible ribbon-like element 20 preferably basically consists of a flexible and substantially inextensible strip of plastic material.

With reference to FIGS. 1, 2, 3 and 4, preferably the manually-operated coupling assembly 19 in turn comprises: a first anchoring structure stably located on the foot-case 2, along the outer side of foot-case 2; a second anchoring structure stably located on the cuff 3, at/flush to the outer side of foot-case 2; and a manually-operated coupling and tensioning device, which is stably located on the transversal locking band 18, preferably at or in proximity of the second end of the same transversal locking band 18, and is selectively connectable/couplable, on choice and alternatively, to the first or to the second anchoring structure in a rigid and stable, though easily releasable manner, so as to anchor the locking band 18, on choice and alternatively, to the foot-case 2 or to the cuff 3, always along the outer side of the foot-case 2.

More specifically, the coupling assembly 19 preferably comprises: a movable anchoring element 21 which is fixed/fixable in a rigid and stable, though easily removable manner, on choice and alternatively to the foot-case 2 or to the cuff 3, in proximity of the outer longitudinal edge 13*a* of protective tongue 13 and/or in the proximity of the connecting hinge 11; and a manually-operated coupling and tensioning device, which is firmly and stably fixed to the transversal locking band 18, or rather to the flexible ribbon-like element 20, and is adapted to couple in a rigid and stable, though easily releasable manner, to the movable anchoring element 21 and then to tighten the entire transversal locking band 18.

In other words, the coupling and tensioning device is adapted to couple the second end of the transversal locking band 18, or rather the second end of the flexible ribbon-like element 20, in a rigid and stable, though easily releasable manner, to the anchoring element 21, and then to tighten the entire transversal locking band 18.

Preferably said coupling and tensioning device is moreover a manually-operated cable-tightening device 22, which is provided with a flexible cable 23 with a substantially inextensible structure, which forms an extension of the transversal locking band 18, or rather of the flexible ribbon-like element 20, and is adapted to firmly couple to the anchoring element 21.

The cable-tightening device 22 is adapted to selectively tighten the flexible cable 23, in order to tighten the entire transversal locking band 18.

More specifically, with reference to Figures from 1 to 4, the movable anchoring element 21 is preferably structured so as to couple/interlock in a rigid and stable, though easily removable manner, on choice and alternatively into a first seat 24 located on the outer side of the foot-case 2, preferably in proximity of the outer longitudinal edge 13*a* of protective tongue 13 and/or in proximity of the connecting hinge 11; and into a second seat 25 located on the outer side of cuff 3, immediately over the outer side of foot-case 2, preferably in proximity of the outer longitudinal edge 13*a* of protective tongue 13 and/or in proximity of the connecting hinge 11.

The seat 25 is furthermore moved upwards with respect to the seat 24. In other words, the seat 25 is at a height from the sole 7 greater than the seat 24.

The cable-tightening device 22, on the other hand, is preferably located on the distal end of the transversal locking band 18, or rather on the distal end of the flexible ribbon-like element 20.

Preferably, the cable-tightening device 22 is furthermore a small manually-operated winch, which is structured so as to selectively wind the flexible cable 23 inside itself, stably lock the flexible cable 23, and finally unwind the flexible cable 23. The flexible cable 23, additionally, is preferably made of metallic material.

In the example shown, in particular, the cable-tightening device 22 is preferably a manually-operated winch marketed by the American company Boa Technology Inc., and being a component already widely known and used in the sports footwear sector it will not be further described.

Figure 3:
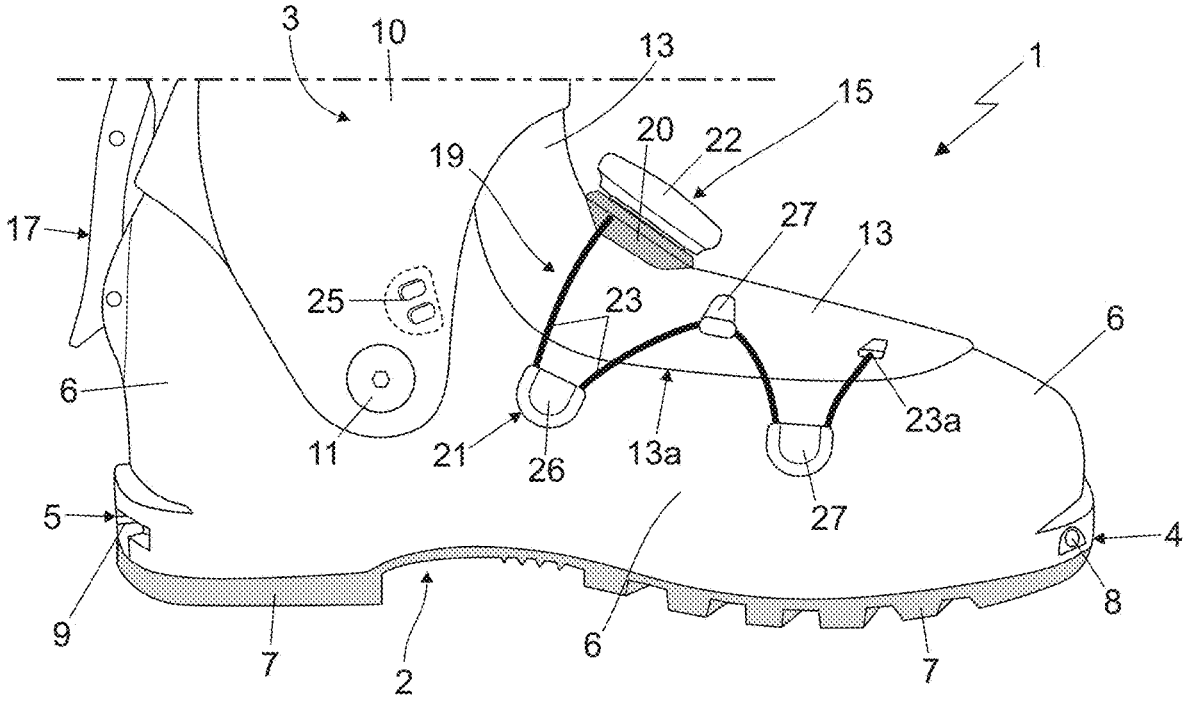
FIG. 3 is a side view of the ski boot illustrated in FIGS. 1 and 2, in a first operating configuration.
Figure 4:
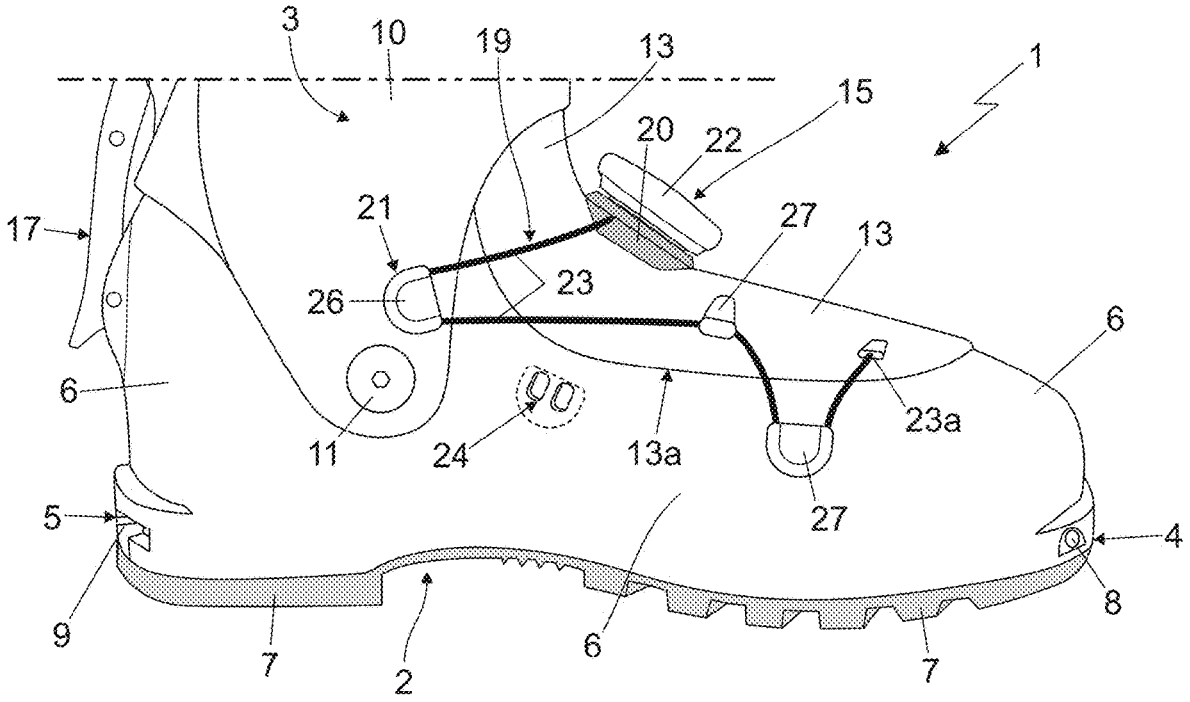
FIG. 4 is a side view of the ski boot illustrated in FIGS. 1 and 2, in a second operating configuration.

With reference to FIGS. 1, 3 and 4, preferably the distal end 23*a* of flexible cable 23 is moreover anchored in rigid manner to the body of protective tongue 13. The movable anchoring element 21, in turn, preferably consists of, or anyway comprises, at least one first fairlead member 26 structured so as to be stably engaged in free slidable manner by a segment of the flexible cable 23.

Besides the main fairlead member 26, the coupling assembly 19 preferably moreover comprises a plurality of supplementary fairlead members 27, which are arranged in an alternated manner on opposite sides of the outer longitudinal edge 13*a* of protective tongue 13, and are rigidly fixed to the foot-case 2 or to the protective tongue 13 immediately beneath.

Preferably, the flexible cable 23 of cable-tightening device 22 moreover engages in pass-through and free slidable manner and in succession the fairlead members 26 and 27, passing from one side to the other of the outer longitudinal edge 13*a* of the tongue.

More specifically, after engaging the fairlead member 26, the flexible cable 23 preferably extends along the outer longitudinal edge 13*a* of protective tongue 13, toward the tip 4 of foot-case 2, engaging in succession the supplementary fairlead members 27.

With reference to FIGS. 1, 2, 3 and 4, in the example shown, in particular, the transversal locking band 18, or rather the flexible ribbon-like element 20, is preferably has a dimensioned so as to place its distal end over the protective tongue 13, preferably substantially astride of the midplane of the ski boot and/or next to the cuff 3.

In other words, the transversal locking band 18, or rather the flexible ribbon-like element 20, is preferably dimensioned such as to place the cable-tightening device 22, or rather the manually-operated winch, over the tongue 13 and next to the cuff 3, substantially astride of the midplane of the ski boot.

The flexible cable 23, in turn, is preferably arranged so as to engage in succession the fairlead members 26 and 27, alternatively passing from one side to the other of the outer longitudinal edge 13*a* of protective tongue 13.

With reference to FIGS. 3 and 4, in the example shown, additionally, the coupling assembly 19 preferably comprises two supplementary fairlead members 27 fixed in rigid manner to the foot-case 2, and one to the protective tongue 13. Preferably, the supplementary fairlead member 27 integral with the protective tongue 13 is moreover arranged in quincunx with respect to the fairlead members 26 and 27 integral with the foot-case 2.

Preferably, the distal end 23*a* of flexible cable 23 is finally firmly fixed to the body of protective tongue 13, close to the front end of protective tongue 13.

With reference to FIG. 1, on the other hand, the cuff closing mechanism 16 preferably comprises: at least one manually-operated lever closing buckle 28, which is located astride of the two oblong and opposite, lateral wings or flaps of cuff 3, so as to be able to selectively pull on toward the other the two wings or flaps of cuff 3, in order to tighten the upper part of the cuff 3 against the user's leg; and optionally also an auxiliary tightening belt 29 with Velcro closure, which is looped around the top of the cuff 3 so as to selectively close/tighten the top of cuff 3 against the calf of the user's leg.

General operation of ski boot 1 is easily inferable from what described above, and does not require further explanations.

As regards instead the operation of the foot-case closing mechanism 15, when the coupling assembly 19 connects the transversal locking band 18 to the foot-case 2, the foot-case closing mechanism 15 operates as a traditional foot-case closing mechanism (see for example the one described in patent application EP3725175 A1) and is capable of tightening the upper part of foot-case 2 against the user's foot, locking it inside the ski boot.

When the coupling assembly 19 connects the transversal locking band 18 to the cuff 3, on the other hand the foot-case closing mechanism 15 succeeds in locking/immobilising the user's ankle, and additionally aids the cuff locking device 17 to keep the cuff 3 still/stationary in the downhill position.

Consequently, the mountaineering skier can, in any moment, choose the configuration of the foot-case closing mechanism 15 that he/she deems the most suitable.

More specifically, the mountaineering skier will anchor the transversal locking band 18 to the foot-case 2 when going up along the snowy slope, and will instead anchor the transversal locking band 18 to the cuff 3 when going down, thus increasing the overall rigidity of the ski boot 1.

The advantages connected to the new foot-case closing mechanism 15 are remarkable and evident.

The foot-case closing mechanism 15 is capable of adapting its tightening onto the foot-case 2 at the use conditions of the ski boot 1, with the enormous advantages that this entails during the practicing of mountaineering ski.

Additionally, the foot-case closing mechanism 15 allows to eliminate, from the inner side of the foot-case 2, any protruding metallic element that may, during use, damage the inner side of the other ski boot.

Last, but not least, the foot-case closing mechanism 15 is much simpler to operate, with the functional advantages that this entails.

It is finally clear that modifications and variations may be made to the above-described ski boot 1 without however departing from the scope of the present invention.

For example, the protective tongue 13 may be made in a single block with the foot-case 2, or rather with the shell 6, and cover the longitudinal slit of the foot-case 2 in overlap configuration.

In other words, one side of the oblong protective tongue 13 is seamlessly joined/merged to the foot-case 2, or rather to the upper part of shell 6, on the side of the longitudinal slit of the foot-case 2, whereas the rest of the protective tongue 13 extends over the longitudinal slit of the foot-case 2, and overlaps the foot-case 2, or rather the upper part of shell 6, on the opposite side with respect to the same longitudinal slit.

The protective tongue 13 is thus provided only with the outer longitudinal edge 13*a*.

In a further not-shown embodiment variation, the distal end 23*a* of flexible cable 23, instead of being firmly fixed to the protective tongue 13, may be anchored to the foot-case 2, preferably in proximity of the front end of the protective tongue 13.

Figure 5:
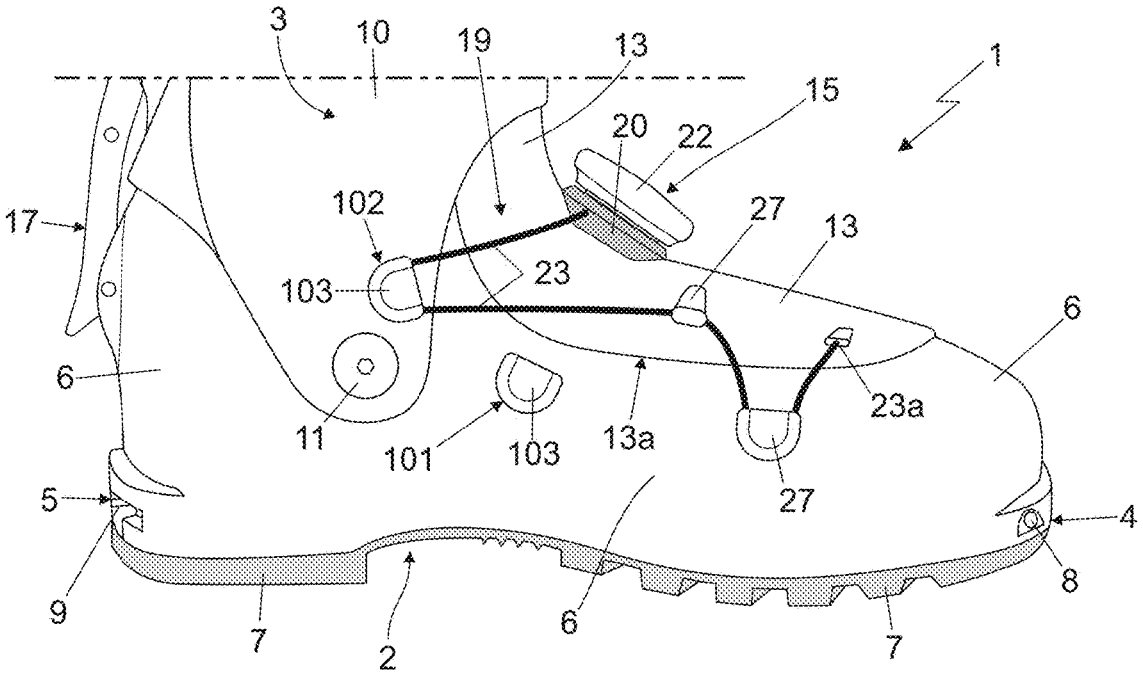
FIG. 5 is a side view of a first alternative embodiment of the ski boot illustrated in the preceding figures, with parts removed for clarity's sake.

According to the embodiment variation illustrated in FIG. 5, on the other hand, instead of being provided with a movable anchoring element 21, the manually-operated coupling assembly 19 is provided with two stationary anchoring elements 101 and 102, which are permanently located one on the foot-case 2 and the other on the cuff 3, along the outer side of the foot-case 2 and in the proximity of the connecting hinge 11.

In other words, the stationary anchoring element 101 is fixed in a rigid and optionally also unmoveable manner to the foot-case 2, preferably in the point where the seat 24 was formerly located. The stationary anchoring element 102, in turn, is fixed in a rigid and optionally also unmoveable manner to the cuff 3, preferably in the point where the seat 25 was formerly located.

Also in this embodiment, furthermore the stationary anchoring elements 101 and 102 may be fairlead members 103.

Figure 6:
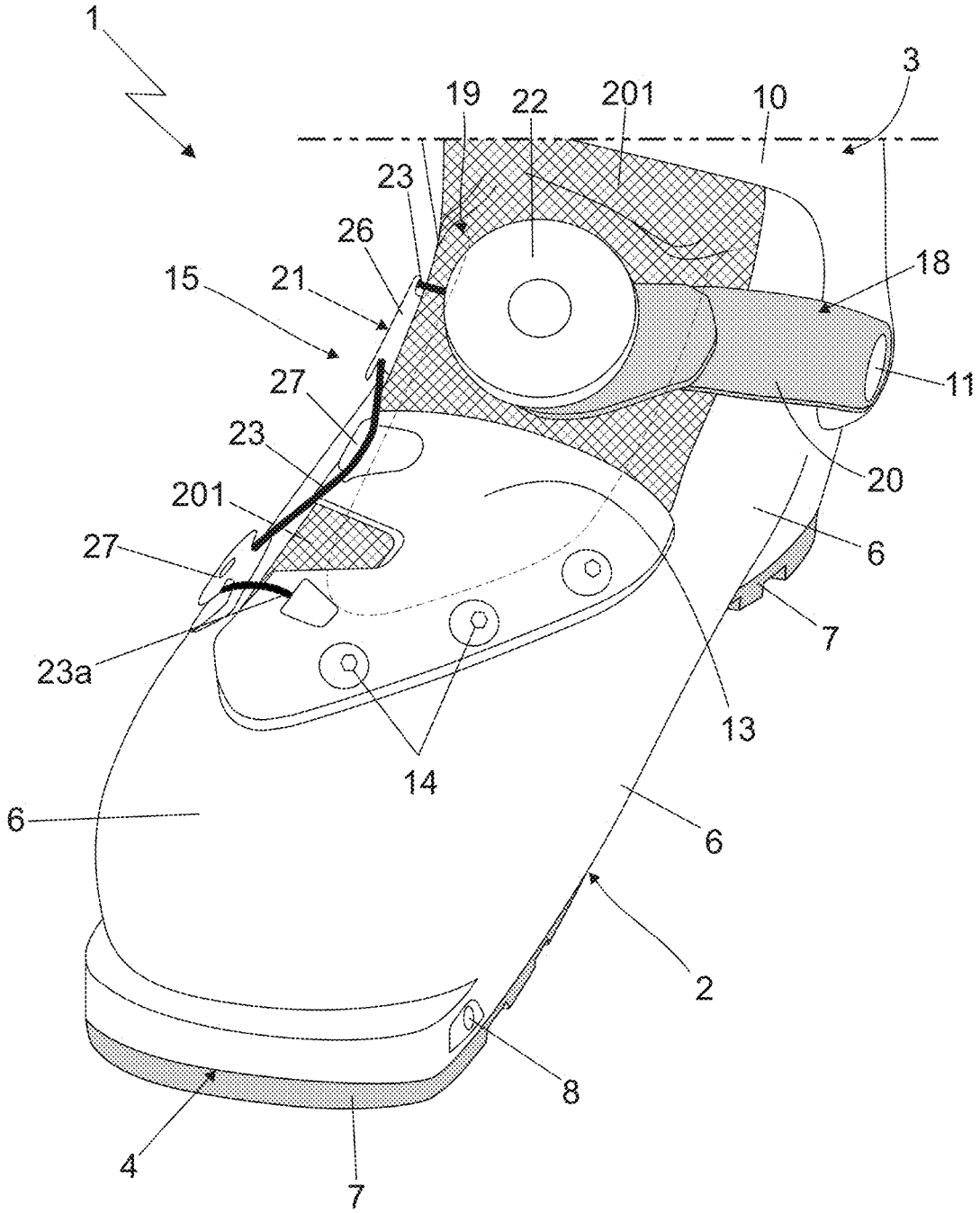

According to an embodiment variation illustrated in FIG. 6, instead, the longitudinal slit of foot-case 2, or rather of shell 6, is closed, preferably watertight, by a gaiter 201 made of fabric, preferably of waterproof type, or other flexible sheet material. In this variation, the protective tongue 13, if present, is preferably arranged resting on the upper part of the foot-case 2, or rather on the upper part of shell 6, over the gaiter 201.

Additionally, the protective tongue 13 is preferably dimensioned so as to cover only the front part of gaiter 201, and thus of the longitudinal slit of foot-case 2, preferably up to arrive next to the distal end of the transversal locking band 18, or rather of the flexible ribbon-like element 20.

Preferably, in this embodiment the front end of protective tongue 13 is furthermore firmly fixed to the upper-front part of the foot-case 2, or rather of shell 6, without the capability of flipping forward more or less obliquely to the midplane of the ski boot.

More specifically, in this embodiment the protective tongue 13 is preferably substantially triangular in shape. Preferably, the protective tongue 13 is finally provided with one or more lightening through openings or slits.

Furthermore, in this embodiment the transversal locking band 18, or rather the flexible ribbon-like element 20, extends obliquely along the inner lateral side of foot-case 2, toward the upper part of the foot-case 2, and is dimensioned so as to arrange its terminal part over the user's instep, flush to the gaiter 201.

Also in this embodiment the coupling assembly 19 is adapted to connect the locking band 18 selectively and alternatively to the foot-case 2 or to the cuff 3, at the opposite side of the foot-case 2 and preferably in proximity of connecting hinge 11. Preferably the coupling assembly 19 is furthermore adapted to tighten and keep tightened the transversal locking band 18.

In other words, also in this embodiment the coupling assembly 19 preferably comprises: a cable-tightening device 22 firmly fixed to the transversal locking band 18, or rather to the distal end of the flexible ribbon-like element 20; and a movable anchoring element 21, or rather a fairlead member 26, fixed in a rigid and stable, though easily removable manner, on choice and alternatively on the foot-case 2 or on the cuff 3.

Clearly, as an alternative to the movable anchoring element 21, the coupling assembly 19 may comprise two stationary anchoring elements, or rather two fairlead members, fixed in rigid manner one to the foot-case 2 and the other to the cuff 3.

Figure 7:
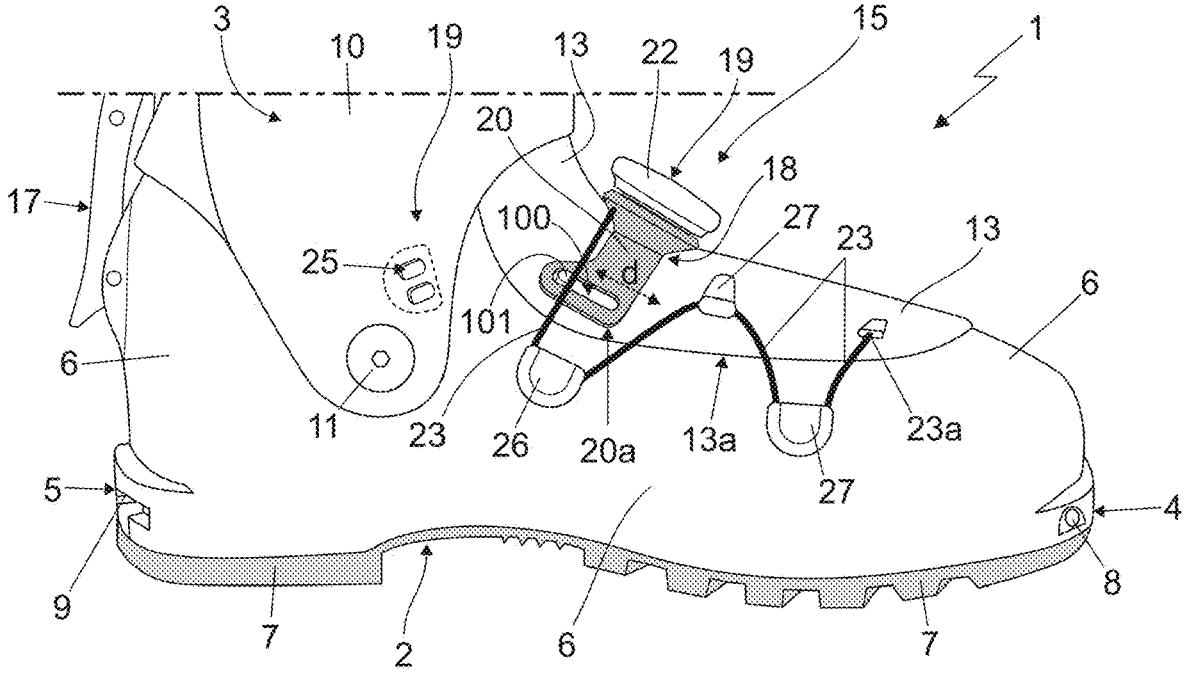
FIGS. 7 and 8 are two side views of a third alternative embodiment of the ski boot illustrated in the preceding figures, in two different operating configurations and with parts removed for clarity's sake.
Figure 8:
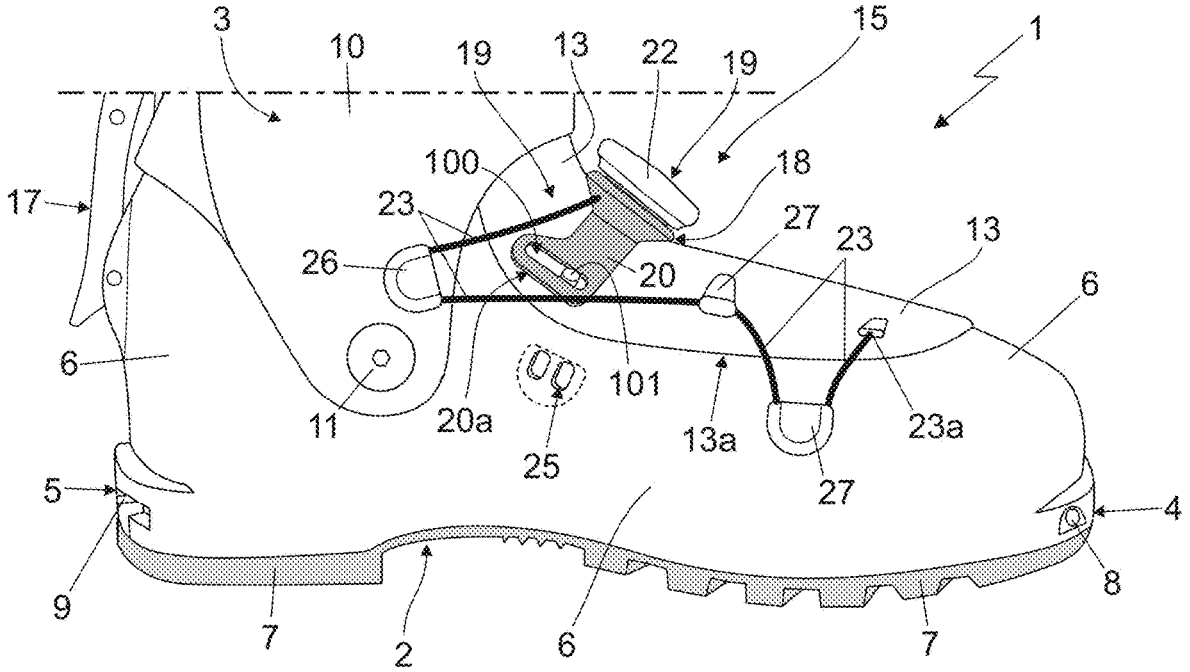

With reference to FIGS. 7 and 8, in a more sophisticated embodiment of the foot-case closing mechanism 15, the second end of the locking band 18, or rather the distal end

20*a* of the flexible ribbon-like element 20, is preferably arranged resting on the protective tongue 13, and is locally stably fixed to the same protective tongue 13 so as to be able to freely slide on the surface of the tongue, in a direction d transversal to the locking band 18.

More specifically, the second end of the transversal locking band 18, or rather the distal end 20*a* of the flexible ribbon-like element 20, is preferably fixed to the protective tongue 13 via a slidable mechanical connection, which allows said second end to freely move on the protective tongue 13 only in a direction d that is flush to the surface of protective tongue 13 and is preferably also locally substantially parallel to the midplane of the ski boot and/or locally substantially perpendicular to the same locking band 18.

Still more specifically, the second end of locking band 18, or rather the distal end 20*a* of the flexible ribbon-like element 20, preferably has a plate-like structure.

Additionally, the locking band 18 preferably has, on the second end, a large oblong-shaped through slot 100, which extends transversally to the locking band 18, or rather to the longitudinal axis of the flexible ribbon-like element 20, and is stably engaged in free slidable manner by a protruding pin 101 which in turn juts out cantilevered from, and is rigidly integral with, the protective tongue 13.

The through slot 100 is preferably also substantially rectilinear and/or parallel to the direction d. Clearly, the through slot 100 could also be arched.

In the example shown, in particular, the through slot 100 is preferably substantially straight, and is preferably substantially perpendicular to the flexible ribbon-like element 20, or rather to the longitudinal axis of the flexible ribbon-like element 20.

The protruding pin 101, in turn, preferably has a mushroom structure so as to retain the distal end 20*a* of the flexible ribbon-like element 20 stably in abutment against the surface of the oblong protective tongue 13, and is preferably made in a one piece with protective tongue 13.

Finally, in a different embodiment of the foot-case closing mechanism 15, the first end of the transversal locking band 18 may be firmly fixed to the outer side of foot-case 2, preferably at connecting hinge 11, whereas the coupling assembly 19 may be structured so as to connect the second end of the transversal locking band 18 selectively and alternatively to the foot-case 2 and/or to the cuff 3, along the inner side of the foot-case 2 and in proximity of the connecting hinge 11.

In other words, in this variation the movable anchoring element 21 is fixed in a rigid and stable, though easily removable manner, on choice and alternatively to the foot-case 2 or to the cuff 3, in proximity of the inner longitudinal edge 13*b* of protective tongue 13 and/or in proximity of the inner connecting hinge 11.

Clearly, also in this case the movable anchoring element 21 may be replaced by the stationary anchoring elements 101 and 102 stably located one on the foot-case 2 or the other on the cuff 3, along the inner side of the foot-case and in proximity of the inner hinge 11.

The invention claimed is:

1. A ski boot comprising:

a rigid foot-case which is adapted to accommodate a user's foot and has a lower part structured to couple with a ski binding device;

a rigid cuff which is adapted to surround a lower part of the user's leg and is pivotally joined to the foot-case so as to be able to rotate about a transversal axis perpendicular to a midplane of the ski boot;

a protective tongue and/or gaiter that closes an upper part of the foot-case; and a foot-case closing means adapted to selectively close/tighten the foot-case on the user's foot, wherein the foot-case closing means comprises:

an oblong, transversal locking band with a flexible and inextensible structure, which extends transversally to the midplane of the ski boot, astride of and flush to the protective tongue and/or gaiter, and has a first end firmly fixed to a first lateral side of the foot-case; and a manually-operated coupling assembly which is adapted to connect a second end of said transversal locking band selectively and alternatively to either one of the foot-case and the cuff, at a second lateral side of the foot-case opposite to said first lateral side.

2. The ski boot according to claim 1, wherein the coupling assembly is adapted to tighten and keep tightened said transversal locking band.

3. The ski boot according to claim 2, wherein the coupling assembly comprises:

a movable anchoring element which is fixed in a rigid and stable, though removable manner, on choice and alternatively on the foot-case or on the cuff, at said second lateral side of the foot-case; and a manually-operated coupling and tensioning device which is firmly fixed on the transversal locking band and is adapted to couple said transversal locking band in a rigid and stable, though releasable manner, to said movable anchoring element while tightening the same transversal locking band.

4. The ski boot according to claim 3, wherein said movable anchoring element is structured so as to be able to couple in a rigid and stable, though removable manner, on choice and alternatively into a first seat located on the second lateral side of the foot-case and into a second seat located on the cuff, immediately over said second lateral side of the foot-case.

5. The ski boot according to claim 3, wherein said coupling and tensioning device is a manually-operated cable-tightening device that is firmly fixed on the transversal locking band and is provided with a flexible cable that forms an extension of the transversal locking band, and is adapted to engage with said movable anchoring element.

6. The ski boot according to claim 5, wherein the flexible cable has a distal end anchored in a rigid manner to a body of the protective tongue or of the foot-case.

7. The ski boot according to claim 5, wherein the cable-tightening device is a manually-operated winch.

8. The ski boot according to claim 5, wherein said movable anchoring element includes a main fairlead member adapted to be engaged in a slidable manner by a segment of the flexible cable.

9. The ski boot according to claim 8, wherein the coupling assembly additionally comprises a plurality of further fairlead members, which are arranged in an alternated manner on opposite sides of a longitudinal edge of the protective tongue adjacent to said second lateral side of the foot-case, and are rigidly fixed to the foot-case or to the protective tongue immediately beneath, the flexible cable of the cable-tightening device being adapted to engage in a pass-through and free sliding manner and in succession said main and further fairlead members, passing from one side to the other of said longitudinal edge of the tongue.

10. The ski boot according to claim 2, wherein the coupling assembly comprises:

a pair of stationary anchoring elements that are stably located one on the foot-case and the other on the cuff, along said second lateral side of the foot-case; and a manually-operated coupling and tensioning device, which is firmly fixed on said transversal locking band and is adapted to couple said transversal locking band in a rigid and stable, though releasable manner, on choice and alternatively to any one of said stationary anchoring elements, while tightening the same transversal locking band.

11. The ski boot according to claim 10, wherein said coupling and tensioning device is a manually-operated cable-tightening device that is firmly fixed on the transversal locking band and is provided with a flexible cable that forms an extension of the transversal locking band, and is adapted to engage/couple with said stationary anchoring elements.

12. The ski boot according to claim 11, wherein said stationary anchoring elements include a first fairlead member and a second fairlead member adapted to be engaged in free slidable manner by a segment of the flexible cable.

13. The ski boot according to claim 12, wherein the coupling assembly additionally comprises a plurality of further fairlead members, which are arranged in an alternated manner on opposite sides of a longitudinal edge of the protective tongue adjacent to said second lateral side of the foot-case, and are rigidly fixed to the foot-case or to the protective tongue immediately beneath, the flexible cable of the cable-tightening device being adapted to engage in a pass-through and free sliding manner and in succession said first or second fairlead member and said further fairlead members, passing from one side to the other of said longitudinal edge of the protective tongue.

14. The ski boot according to claim 1, wherein the first end of said transversal locking band is firmly fixed on said first lateral side of the foot-case, at the hinge connecting the cuff to the foot-case.

15. The ski boot according to claim 1, wherein the transversal locking band comprises a flexible ribbon-like element with an inextensible structure, which has a proximal end firmly fixed to the first lateral side of the foot-case, and extends obliquely along the first lateral side of the foot-case, towards the upper part of the foot-case and the midplane of the ski boot, so as to reach said protective tongue and/or gaiter.

16. The ski boot according to claim 15, wherein said flexible ribbon-like element has a monolithic structure and/or is made of plastic material.

17. The ski boot according to claim 1, wherein said first and said second lateral side of the foot-case are respectively an inner side and an outer side of the foot-case.

18. The ski boot according to claim 1, wherein the protective tongue has a front end firmly fixed to an upper-front part of the foot-case, with the capability of flipping forward.

19. The ski boot according to claim 18, wherein a distal end of a flexible cable is anchored in a rigid manner to a body of the protective tongue or of the foot-case, close to the front end of the protective tongue.

20. The ski boot according to claim 1 wherein the manually-operated coupling assembly is adjustable between: (1) connecting the second end of said transversal locking band to the foot-case; and (2) connecting the second end of said transversal locking band to the cuff.

* * * * *